United States Patent [19]

Schneider et al.

[11] 4,150,616

[45] Apr. 24, 1979

[54] METHOD OF CONTROLLING THE SPEED OF A MECHANICAL PRESS

[75] Inventors: Franz Schneider; Helmut Braitinger, both of Göppingen, Fed. Rep. of Germany

[73] Assignee: L. Schuler GmbH, Fed. Rep. of Germany

[21] Appl. No.: 910,347

[22] Filed: May 30, 1978

[30] Foreign Application Priority Data

Jun. 28, 1977 [DE] Fed. Rep. of Germany ..... 2728982

[51] Int. Cl.[2] ..... B30B 15/14

[52] U.S. Cl. ..... 100/35; 100/48; 100/53

[58] Field of Search ..... 100/35, 43, 48, 53, 100/282; 310/95

[56] References Cited

U.S. PATENT DOCUMENTS

| | | | |
|---|---|---|---|
| 3,138,976 | 6/1964 | Robra | 100/48 |
| 3,407,724 | 10/1968 | Heiberger | 100/43 |
| 3,416,433 | 12/1968 | Gutnikov | 100/48 |
| 3,450,912 | 6/1969 | La Vallee | 310/95 |
| 3,888,168 | 6/1975 | Kent | 100/48 |
| 4,062,213 | 12/1977 | Schneider | 100/43 X |

*Primary Examiner*—Billy J. Wilhite

*Attorney, Agent, or Firm*—Craig & Antonelli

[57] ABSTRACT

A speed controlling arrangement and method for a mechanical press. The press has a crankshaft revolution which can be subdivided in principle into a discharging and charging region and a working region with the speed of the mechanical press being controlled between a maximum admissible speed and a minimum possible speed. The speed of travel of the press ram is controlled so that the speed of the press ram during the press discharging and charging region permits a safe discharging and charging of the press. During the working region, the press ram travels at a maximum permissible speed such that a stoppage of the press between the discharging and charging region and the working region is unnecessary.

11 Claims, 6 Drawing Figures

METHOD OF CONTROLLING THE SPEED OF A MECHANICAL PRESS

Figure 1:
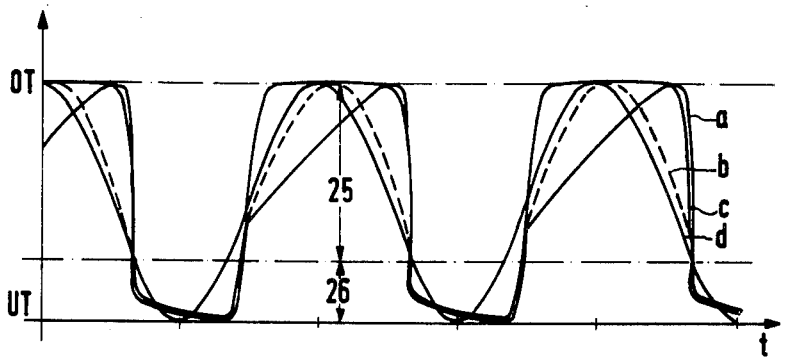

The present invention relates to a mechanical press construction and, more particularly, to a control arrangement and method for controlling a mechanical press having a crank revolution which is divided, in principle, into a discharging and charging region and a working region, with the speed of a press ram being controlled between a maximum and minimum possible speed.

In Offenlegungsschrift No. 1,752,794 and U.S. Pat. No. 3,450,912, a control arrangement is proposed wherein a controllable eddy current coupling and a controllable eddy current brake form an electromagnetically acting coupling brake unit operatively arranged in a press drive between a flywheel, constantly driven by a main press drive, and a drive shaft for the press ram. The electromagnetically acting coupling brake unit regulates the speed of the press ram within relatively wide limits. By means of this method and control arrangement, substantially purely mechanical, articulated drives are simulated which produce a working region with virtually constant but low-speed press ram displacement and a charging and discharging region with an approximately sinusoidal, high-speed press ram displacement. This known control arrangement is also applicable to presses which are combined to form an automated and/or synchronized press ram.

Rather than arranging a mechanical press of the aforementioned type in a press line, such presses are also customarily operated in a single-stroke service. In such operation, it has been proposed to control the mechanical presses by a photoelectric means which provides a light curtain enclosing a working space of the press as a safety measure for press operators charging and discharging the press.

In a single-stroke service or operation of a press, the press is generally adjusted to the maximum possible stroke frequency, that is, an optimum speed for permitting a high output of a finished part. However, a minimum time interval must also be taken into consideration between the passage of the press ram through the top dead-center position and the next stroke or passage of the press ram. This minimum time interval is generally governed by the time required by press operators to safely discharge and charge the press without difficulty. In operation, the press is charged and then started whereby the press ram executes a working stroke and is stopped subsequent to the working stroke in a top dead-center position. After the expiration of a minimum time interval, the press is again started provided that the press operator or operators have correctly discharged and charged the press and are outside of a danger zone protected by the light curtain, which curtain is inoperative in the discharging and charging region of the press.

As evident from the above proposed press control arrangements, when it is desired to achieve a high output of machined parts, it is necessary in any case to adjust the press to a maximum possible stroke frequency or speed with a stoppage of the press after each stroke or work cycle inevitably becoming necessary in order to permit a discharge and charge of the press safely and without difficulty. Such mode of operation is disadvantageous by virtue of the fact that there is a loss of energy at each braking and starting process, as well as increased wear at the coupling brake units. Moreover, such operation increases the loading of the entire press drive and of the press itself and, not the least consideration, generates considerable noise by virtue of the constantly switched coupling brake units.

The aim underlying the present invention essentially resides in providing a control arrangement and method for controlling a mechanical press operated in a single-stroke manner, whereby a stopping of the press between working strokes is unnecessary.

In accordance with advantageous features of the method of the present invention, the speed of the press ram in a discharging and charging region is set so as to permit a trouble-free and safe discharging and charging with the speed of the press ram in the working region being set so that the press ram travels at a maximum permissible speed, whereby a stoppage of the press between the discharging and charging region and the working region is rendered unnecessary.

According to yet further advantageous features of the present invention, the working region is divided into a tool closing, a tool working and a tool opening phase with the press ram travelling at higher speeds during the tool closing and opening phases than during a tool working phase.

By virtue of the method in accordance with the present invention, it is possible to obtain an optimum utilization of a mechanical press in that the speed of the press ram can be adapted, as desired, and can be adjusted for each workpiece and for the skill of the operator manning the press so that the press achieves a high output of machined workpieces in every case and, at the same time, can be operated continuously without stopping.

According to the present invention, a drive shaft for the press ram is driven by a main press drive through a controllable eddy current coupling and eddy current brake with the eddy current coupling and brake being connected to and controlled by a programmable control means.

In accordance with further advantageous features of the present invention, a gear train is interposed between a press flywheel and the drive shaft of the press ram, through which gear train the rotary speed of a control drive can be superimposed upon the rotary speed of the drive shaft. Preferably, the gear train is constructed as a superimposing gear which is connected, on the one hand, to the main press drive and, on the other hand, to the control drive which, in turn, is connected to and controlled by the programmable control means.

The control drive, according to the present invention, may be connected to the drive shaft of the press ram during a charging and discharging region through a first coupling with the press main drive being connected to the drive shaft through another coupling during the working region.

Preferably, according to the present invention, the main press drive includes a virtually inertia-free, direct-current drive means with a variable speed within wide limits.

To provide for a constant-speed main press drive, according to the present invention, an asynchronous motor rotating at virtually a constant speed is provided and drives a synchronous generator equipped with a particular flywheel mass which generates an alternating voltage, the frequency of which is variable in a controllable inverter. The output of the alternating voltage of the controllable inverter is fed to a synchronous motor which drives the drive shaft through a coupling brake unit.

To minimize the noise which occurs during the operation of the press, in accordance with another feature of the present invention, the couplings and/or coupling brake units are constructed as hydraulically-actuated couplings.

Accordingly, it is an object of the present invention to provide a control arrangement and method for presses which avoid by simple means the shortcomings and drawbacks encountered in the prior art.

Another object of the present invention resides in providing a control arrangement and method for controlling presses which reduce the wear and loading on the entire press drive and substantially reduce the noise developed during operation of the press.

A further object of the present invention resides in providing a control arrangement and method for controlling presses which maximize the output of the press and, at the same time, permit continuous operation of the press between subsequent strokes.

An additional object of the present invention resides in providing a control arrangement and method for controlling a mechanical press which function reliably under all operating conditions.

Yet another object of the present invention resides in providing a control arrangement for a press which is simple in construction and, therefore, relatively inexpensive to manufacture.

These and other objects, features and advantages of the present invention will become more apparent from the following description when taken in connection with the accompanying drawings which show, for the purposes of illustration only, several embodiments in accordance with the present invention, and wherein:

FIG. 1 is a schematic diagram illustrating a plurality of movement cycles of a press ram of a mechanical press; and FIGS. 2–6 are schematic partial cross-sectional views of several embodiments of control arrangements for press drives of mechanical presses in accordance with the present invention.

Referring now to the drawings wherein like reference numerals are used throughout the various views to designate like parts and, more particularly, to FIGS. 2–6, press drives are provided which include, in general, a speed-regulated direct-current drive 10 which acts directly upon a flywheel mass 11 or 11' which, in turn, may be connected through a gearbox, layshaft and coupling brake unit, not shown in detail, to a drive shaft of a crankshaft or eccentric shaft 12 to which a ram 13 of a mechanical press is articulated.

Figure 2:
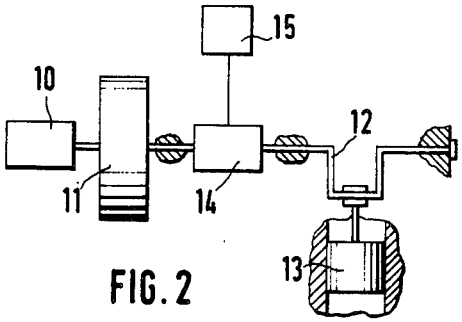

In FIG. 2, a coupling brake unit is provided which includes a controlled eddy current coupling and eddy current brake 14 which, as noted hereinabove, is conventional in press construction. A programmable control means 15 is provided for controlling the behavior of the eddy current coupling and brake 14.

Figure 3:
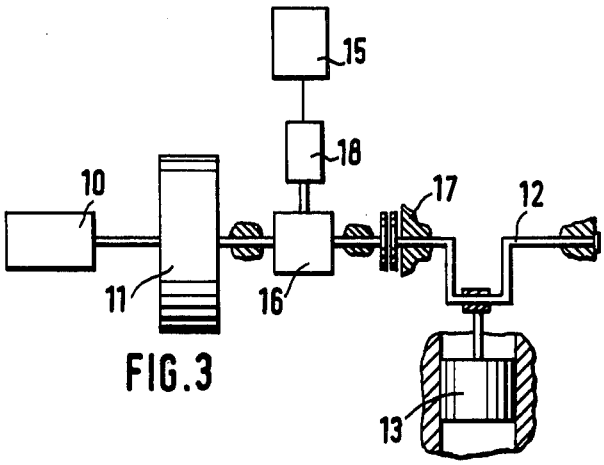

As shown in FIG. 3, in lieu of an eddy current coupling and eddy current brake 14, a superimposing multiple input gear means 16 may be provided with a conventional coupling brake unit 17 being disposed after the gear means in the torque transfer path. A second input of the gear means 16 is connected to a control drive 18 with the behavior of the control drive 18 being controlled or influenced by the programmable control means 15.

Figure 4:
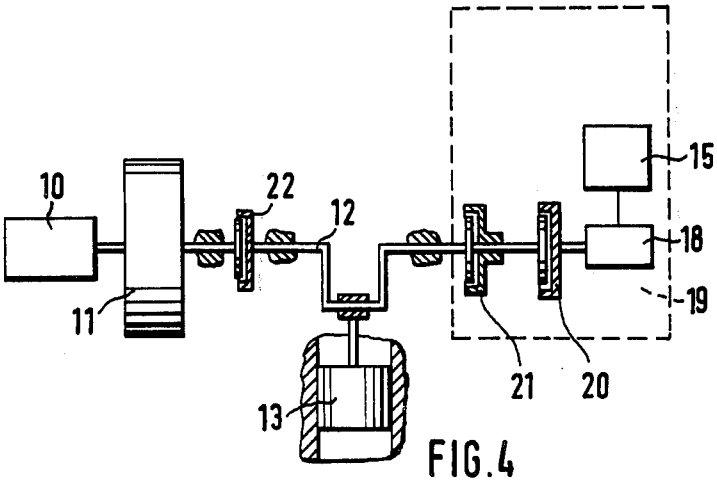

In FIG. 4, a mechanical press is provided with a gear train 19 which, in principle, includes the control drive 18 and the programmable control means 15. The control drive 18 acts through a coupling 20 upon the crankshaft 12 of the press ram 13 with the crankshaft 12 being connected to a brake 21. The direct-current drive 10 and the flywheel mass 11 are connectable to the crankshaft 12 through a coupling 22. The couplings 20, 22 are preferably constructed as hydraulically-actuated couplings operating virtually noise-free and may be mounted in a housing as clutches.

Figure 5:
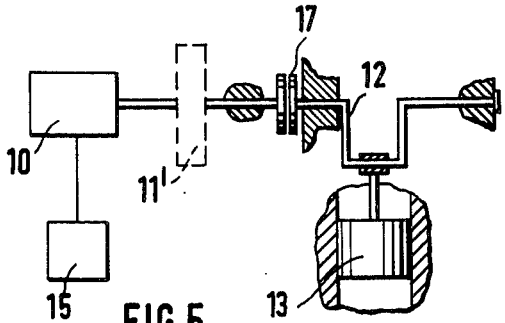

As shown in FIG. 5, the programmable control means 15 may act directly upon the direct-current drive 10 which, when appropriately dimensioned, has a particular flywheel 11' and is operatively associated with the crankshaft 12 through a coupling brake unit 17.

Figure 6:
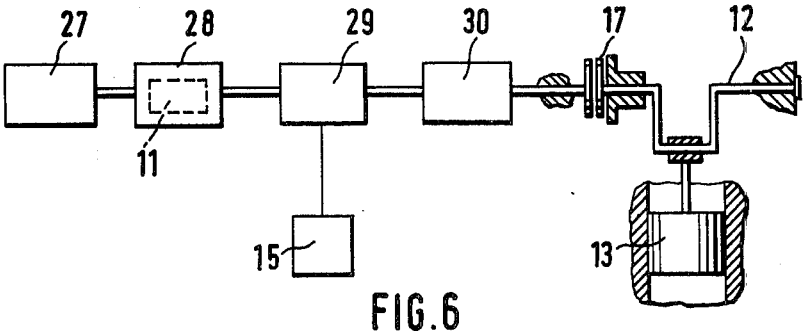

In FIG. 6, a construction similar to that of FIG. 5 is provided, wherein an asynchronous motor 27, which rotates at virtually constant speed, drives a synchronous generator 28 which is connected to the flywheel mass 11'. The alternating voltage output available from the synchronous generator 28 is fed to an inverter 29 to which the programmable control unit 15 is connected. The inverter 29 delivers an output alternating voltage, the frequency of which is determined by the programmable control means 15 with the output being fed to a synchronous motor 30. As with the previous control arrangements, the synchronous motor 30 drives the press through the coupling brake unit 17.

The functions of the control arrangements according to FIGS. 2–6 will now be described with reference to the illustrative diagram of FIG. 1, wherein the hub represents the stroke of the press ram with OT and UT representing top dead-center and bottom dead-center positions, respectively.

As an initial curve, the curve d shows a pure sinusoidal pattern of the ram movement (stroke) over a given time (t) such as obtainable with an eccentric or crank press with, for example, a direct-current drive 10 of a constant speed in continuous operation. The movement curves can be modified by the use of articulated drives such as proposed, for example, in German Patent No. 1,240,802 so that a region of the total stroke, the charging and discharging region 25, is travelled at a high speed, whereas in a working region 26, the press ram 13 is driven at a constant but low speed. Drives of this latter type are generally used in drawing presses. Such a drive has been chosen in order to explain the control arrangements of the prior art which are characterized by the curve c. The press, the ram movement of which corresponds to the curve c, is adjusted to its maximum possible stroke frequency, that is, working speed, so that a relatively high output is achieved. Because of the adjusted high stroke frequency, the time between two descents of the press ram 13 is not sufficient to permit a safe and trouble-free discharging and charging of the press by the operator or operators so that the ram 13 is generally stopped in a top dead-center position or in a stopping point after each work stroke and again restarted after a predetermined time which is governed by the charging and discharging time of the press. The coupling and the brake of the press must therefor be actuated at each work stroke, resulting in the disadvantageous consequences set forth hereinabove.

By the control arrangement and method of the present invention, it is possible to obtain a ram movement pattern such as shown by the curves a, b wherein the press is no longer stopped between strokes, but is operated in a continuous service, although the movement cycle of the press ram 13 must be susceptible to influence within wide limits.

The curve a provides an example of the operation of a press with manual charging and discharging. The values corresponding to the curve a are fed into the programmable control means 15. The press is driven at a maximum possible speed in the working region 26 while the tool closing and tool opening phase is travelled at high speed and the tool working phase lying therebetween is travelled at a low constant speed corresponding to an articulated drive. In the charging and discharging phase which, in the case of manual operation, commences upon the completion of the tool opening phase at the end of the working region 26 and is terminated at the top dead-center position OT, the speed of the press ram 13 is reduced so much that a trouble-free and safe charging and discharging is ensured without stopping the press. After reaching the top dead-center position OT, the press is again accelerated to the maximum possible speed and the above-described work cycle is then repeated.

The curve b provides an example of a press utilizing mechanical discharging and charging devices. In such a situation, the speed of the press can be controlled in such a manner that the charging and discharging region 25 commences at the tool opening phase and terminates at the tool closing phase. A safety zone such as is necessary in order to protect operators in case of a manual operation can be omitted with a mechanized or automated press.

The curves a and b can be obtained in the control arrangement of FIG. 2 by an appropriate programming of the control means 15 and a controlling of the eddy current coupling and brake 14.

With the control arrangement of FIG. 3, a rotary speed is superimposed upon the crank or eccentric shaft, driven in a known manner at a constant speed by the direct-current drive through the flywheel mass 11 and the couplng brake unit 17, by the interposed superimposing gear 16, whereby a resulting ram movement cycle is obtained which can correspond to the curves a and b in FIG. 1.

With the control arrangement shown in FIG. 4, the control drive 18 is connected through the coupling 20 to the crankshaft 12 during the charging and discharging phase 25. During this time, the coupling 22 is opened. On the other hand, in the working phase 26, the coupling 20 is vented and the opening 22 is engaged. The energy necessary for the deformation can now be taken from the flywheel mass 11. The direct-current drive and the flywheel mass 11 in this arrangement can be dimensioned in such a manner that the energy and/or speed required in the working region 26 is available. A lighter weight construction of the press can thereby be achieved in an advantageous manner.

In the control arrangement of FIG. 5, the direct-current drive 10 is controlled directly by the control means 15. In this construction, only the particular flywheel mass 11' of the direct-current drive 10 and that of the other driven parts (12, 13, 17) of the press are operative.

With the control arrangement of FIG. 6, which is the closest to the arrangement of FIG. 5, the speed curve of the press ram 13 which is driven indirectly by the asynchronous motor 27, corresponding to the curves a, b, is obtained by controlling the frequency of the voltage available from the inverter 29 and fed to the asynchronous motor 27.

In addition to the above-described control arrangements, in a few special situations, a purely mechanical solution may also be advantageous for effecting the control and performing the method according to the present invention, in which case a particularly conformed articulated drive could be utilized. However, such solution can only be contemplated for specific applications without farther reaching possibilities of variation.

While we have shown and described several embodiments in accordance with the present invention, it is understood that the same is not limited thereto, but is susceptible of numerous changes and modifications as known to those skilled in the art, and we therefor do not wish to be restricted to the details shown and described hereinabove, but intend to cover all such changes and modifications as are encompassed by the scope of the appended claims.

We claim:

1. A speed controlling method for a mechanical press having a crankshaft revolution which can be subdivided in principle into a discharging and charging region and a working region, wherein the speed of the mechanical press is controlled between a maximum admissible speed and a minimum possible speed, the press including a press ram, the method comprising the steps of:

moving the press ram during the discharging and charging region and during the working region; and controlling the movement of the press ram so that the press ram is moved at a first speed in the discharging and charging region so as to permit a trouble-free and safe discharging and charging of the press and at the maximum admissible speed during the working region so that a stoppage of the mechanical press between the discharging and charging region and the working region is unnecessary.

2. A method according to claim 1, wherein the working region is divided into a tool closing phase, a tool working phase and a tool opening phase, and wherein the step of controlling the movement of the press ram includes causing the press ram to move at a higher speed during the tool closing phase and the tool opening phase than during the tool working phase.

3. A speed control arrangement for controlling the speed of a mechanical press, the mechanical press having a crankshaft revolution which can be subdivided into a press discharging and charging region and a press working region, the press working region including a tool closing phase, a tool working phase and a tool opening phase, the mechanical press including a drive shaft means operatively connected to a press ram, and a main press drive means operatively connected to the drive shaft means, the control arrangement comprising:

a control means operatively connected with at least one of the main press drive means and the drive shaft means for controlling a speed of the press ram during the press discharging and charging region and during the press working region so that the press ram travels at a speed which permits a safe discharging and charging of the press during the press discharging and charging region and at a maximum permissible speed during the working region with the press ram travelling at a higher speed during the tool opening and tool closing phases than during a tool working phase such that a stoppage of the mechanical press between the press discharging and charging region and the working region is unnecessary.

4. An arrangement according to claim 3, wherein said control means includes a controllable eddy current coupling and eddy current brake means interposed between the main press drive means and the drive shaft means, and a programmable control unit operatively connected with the coupling means and brake means for controlling the behavior of the coupling means and brake means.

5. An arrangement according to claim 3, wherein the control means includes a gear means disposed between a flywheel of the mechanical press and the drive shaft means, and control drive means operatively connected with the gear means for superimposing a rotary speed upon the drive shaft means.

6. An arrangement according to claim 5, wherein the gear means includes a superimposing gear operatively connected with the main press drive means and the control drive means, and wherein a programmable control unit is operatively connected with the control drive means for controlling the rotary speed of the control drive means.

7. An arrangement according to claim 3, wherein the control means includes a control drive means operatively connected to the drive shaft means, a first coupling means for coupling the control drive means with the drive shaft means during the press charging and discharging region, and a further coupling means for coupling the main press drive means with the drive shaft means during the press working region.

8. An arrangement according to claim 7, wherein the first coupling means and the further coupling means are constructed as hydraulically-actuated couplings.

9. An arrangement according to claim 3, wherein the main press drive means includes a virtually inertia-free direct-current drive having means for varying the speed of the drive within wide limits.

10. An arrangement according to claim 3, wherein the main press drive means includes an asynchronous motor having a virtually constant speed, a synchronous generator means provided with a flywheel mass for generating an alternating voltage output signal, and wherein the control means includes a controllable inverter means for varying a frequency of the output signal of the generator means and for providing an output alternating voltage signal, a synchronous motor for driving the drive shaft means, the output alternating voltage signal of the inverter means being fed to the synchronous motor, and a coupling brake means for coupling the synchronous motor to the drive shaft means.

11. An arrangement according to claim 10, wherein the coupling brake means are constructed as a hydraulically-actuated coupling.

* * * * *